US006129135A

United States Patent [19]

Divecha et al.

[11] Patent Number: 6,129,135

[45] Date of Patent: Oct. 10, 2000

[54] FABRICATION OF METAL-MATRIX COMPOSITIONS

[75] Inventors: Amarnath P. Divecha, Falls Church; Subhash D. Karmarkar, Great Falls, both of Va.; William A. May, Boulder, Colo.; James M. Kerr, Ashburn, Va.; William A. Ferrando, Arlington, Va.; Scott M. Hoover, Burtonsville, Md.

[73] Assignee: The United States of America as represented by the Secretary of the Navy, Washington, D.C.

[21] Appl. No.: 09/342,207

[22] Filed: Jun. 29, 1999

[51] Int. Cl.[7] ..... B22D 19/14; B22D 27/00

[52] U.S. Cl. ..... 164/97; 164/66.1; 164/68.1

[58] Field of Search ..... 164/97, 98, 66.1, 164/68.1

[56] References Cited

U.S. PATENT DOCUMENTS

| | | | |
|---|---|---|---|
| 3,941,903 | 3/1976 | Tucker, Jr. | 427/190 |
| 4,431,448 | 2/1984 | Merzhanov et al. | 75/238 |
| 4,735,655 | 4/1988 | Gunter et al. | 75/231 |
| 4,786,467 | 11/1988 | Skibo et al. | 420/129 |
| 4,946,647 | 8/1990 | Rohatgi et al. | 420/528 |
| 4,951,392 | 8/1990 | Miihkinen et al. | 29/895.221 |
| 5,025,849 | 6/1991 | Karmarkar et al. | 164/97 |
| 5,295,528 | 3/1994 | Divecha et al. | 164/75 |
| 5,337,803 | 8/1994 | Divecha et al. | 164/98 |
| 5,509,459 | 4/1996 | Divecha et al. | 164/98 |

*Primary Examiner*—Harold Pyon
*Assistant Examiner*—I.-H Lin
*Attorney, Agent, or Firm*—John Forrest; Jacob Shuster

[57] ABSTRACT

A predetermined quantity of a metal-matrix composite material is injected into a heating crucible along an angular infeed direction toward a location therein at which a vortex is formed by the blade of an agitator through which the material is stirred while being superheated above the melting temperature to a pouring temperature under which the melted material is transferred to a casting mold after surface skimming thereof to form a product having improved wear resistance properties.

4 Claims, 1 Drawing Sheet

FABRICATION OF METAL-MATRIX COMPOSITIONS

The present invention relates in general to the development of improved properties such as wear resistance, during fabrication of metal-matrix composites.

BACKGROUND OF THE INVENTION

Metal-matrix composites are currently utilized in a wide variety of installations because of their ability to rapidly dissipate heat and provide good shock resistance and corrosion resistance during exposure to seawater. Such metal-matrix composites however suffer from certain undesirable attributes during use involving excessive wear and/or erratic frictional characteristics. Conventional means have been utilized to overcome such undesirable attributes by improving wear resistances, involving the use of weld overlay, and plating or flame spraying of hard coatings. Such conventional wear improvement means for metal-matrix composites have been only marginally successful in increasing service-life, as well as being economically costly. It is therefore an important object of the present invention to provide a more economical and more effective method of improving the wear resistance characteristics of metal-matrix composites.

SUMMARY OF THE INVENTION

In accordance with the present invention, a powderized alloy from which a metal-matrix composite is fabricated, is directed into a heating chamber or a crucible toward a certain location therein to collect a predetermined quantity of material for superheating above a melt temperature to a pouring temperature. Such introduction of the metal-matrix with alloy powder therein into the heating crucible is accompanied by adjusted infeed of an air purging gas such as argon. During such infeed, the material being collected in the crucible and heated to a molten state is agitated by motorized rotation of a stirring blade creating a vortex in the material at the aforesaid location toward which the material infeed is directed. After expiration of two sequential periods of 5 minute duration for example, during which infeed and additional heating of the material to a molten state respectively occurs, the surface of the melt is skimmed before it is poured into a casting mold, such as an ingot forming mold from which a cooled billet is extracted as the fabrication product having improved metallurgical properties as aforementioned.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing wherein:

FIG. 1 is a partial side section view of apparatus in accordance with one embodiment of the present invention for carrying out the fabrication process associated therewith; and FIG. 2 is a block diagram of the fabrication process.

DETAILED DESCRIPTION OF PREFERRED EMBODIMENT

Figure 1:
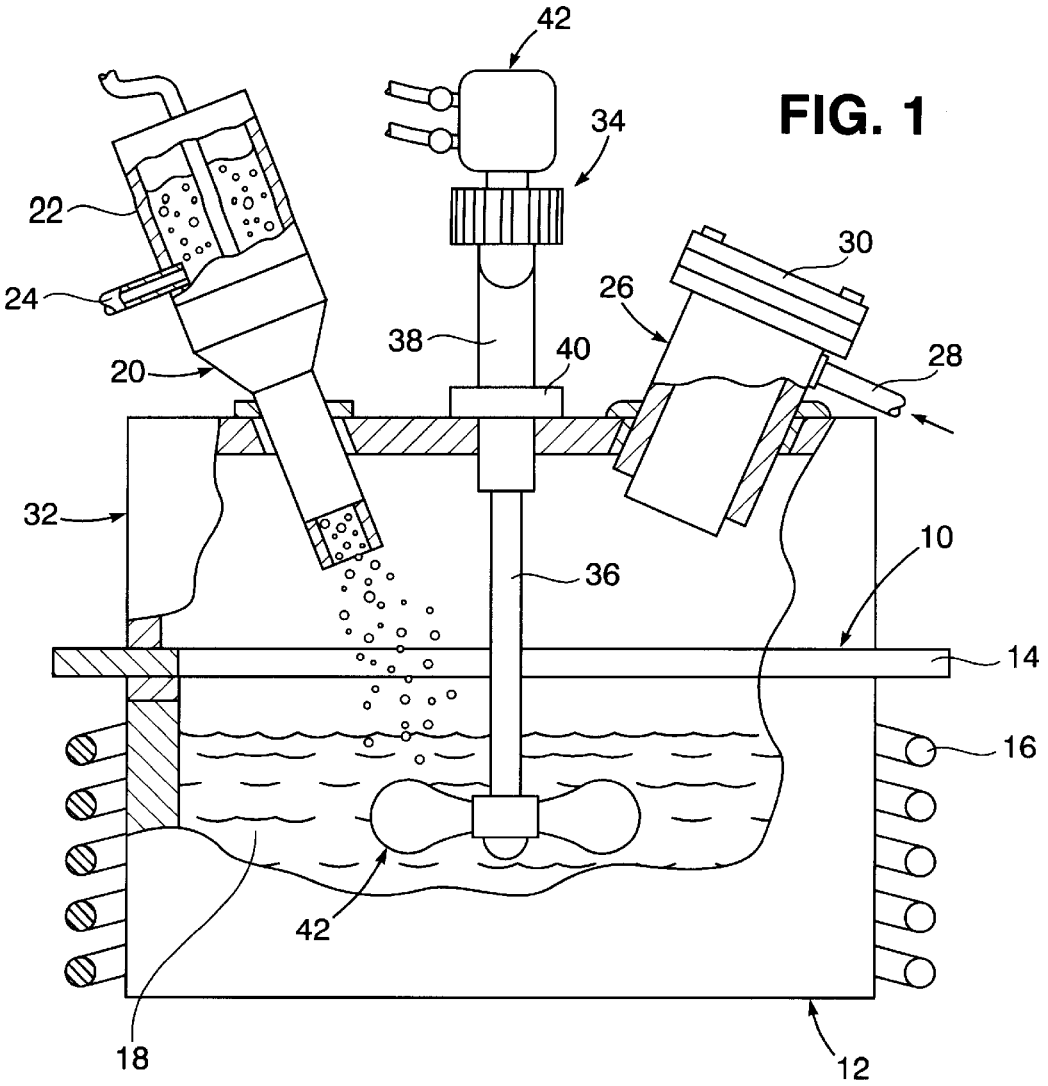

Referring now to the drawing in detail, FIG. 1 illustrates apparatus through which the process of the present invention may be performed. Such apparatus includes a heating furnace generally referred to by reference numeral 10, having a cylindrical crucible 12 made of clay bonded graphite underlying a furnace top 14. The crucible 12 is surrounded by an electrical induction heating coil 16 through which a composite metallic melt material 18 enclosed within the crucible chamber is controllably heated to a pouring temperature by electrical power at a 50 Kw, 3000 Hertz level for example. A predetermined quantity of the material 18 utilized in one embodiment of the invention was 30 pounds of 954 Bronze alloy formed from 85% copper, 4% iron and 11% aluminum, to which a weighted quantity of TiC/Al master alloy powder or a commercial TiC powder was added. Such material 18 was accordingly super-heated within the crucible 12 to 1100° C., as the pouring temperature which is about 60° C. above a liquidus melt temperature of 1037° C. for the bronze alloy. Such heating is performed while the predetermined quantity of the material 18 is deposited into the crucible 12 by gravitational inflow through a funnel 20 from a cylindrical enclosure 22. An air purging gas such as argon is introduced into the enclosure 22 through an infeed tube 24 for oxygen removal purposes. Additional adjusted inflow of argon is introduced through a cylindrical observation viewing device 26 having an argon infeed tube 28 fixed thereto and a viewing window 30 as shown in FIG. 1. The viewing device 26 and funnel 20 are fixedly supported by a cylindrical furnace cover 32 in spaced relation above the furnace top 14 on opposite sides of an agitator assembly 34, at converging angles to each other.

With continued reference to FIG. 1, the agitator assembly 34 includes a protectively coated agitator shaft 36 extending into the material 18 within the crucible 12 from an attached cylindrical extension rod 38 journalled in the cover 32 by a support bearing 40 between the funnel 20 and viewing device 26. A stirring blade 42 having a 15°–20° pitch for example, is fixed to the lower end of the agitator shaft 36, connected at its upper end by extension rod 38 to an electrical drive motor 44. The agitator shaft 36 is made of a wrought molybdenum alloy TZM, developed for elevated temperature applications having a recrystallization temperature of about 1300° C., sufficiently above the maximum processing temperature for the bronze alloy material 18 in the crucible 12 to which the shaft 36 is exposed. As to the stirring blade 42 connected to the lower end of the agitator shaft 36 within the material 18, it was fabricated from pure wrought molybdenum having rounded edges to insure good adhesion thereto of a heavy refractory coating of zircoma.

Figure 2:
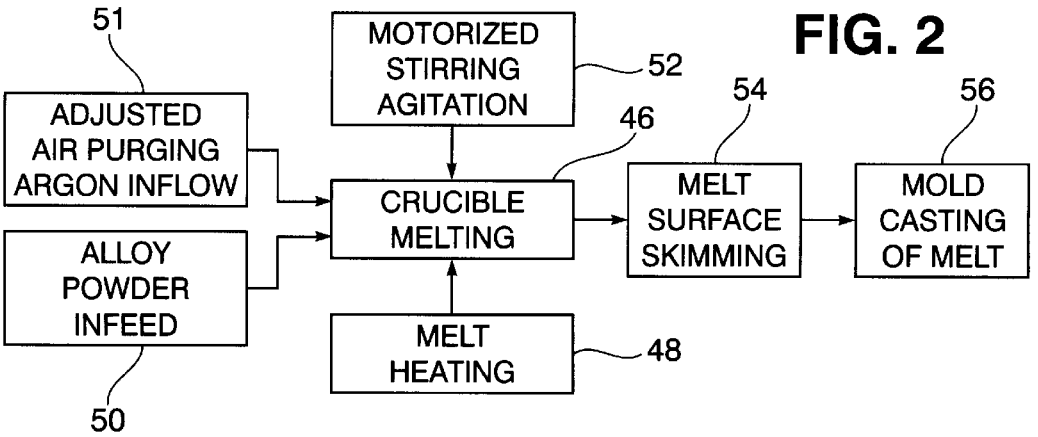

The metallurgical fabrication process of the present invention utilizing apparatus such as that shown in FIG. 1 as hereinbefore described, is diagrammed in FIG. 2. Melting 46 with the crucible is effected by heating 48 elevating the material 18 to the pouring temperature of 1100° C. as aforementioned, while such material is collected within the crucible 22 by infeed 50. During initial melting, motorized stirring agitation 52 is performed at a sufficient rotational speed of the agitator blade 42 to create a 3"–4" deep vortex in the material 18. The infeed 50 through the funnel 20 is directed at an angle toward the locational center of the vortex formed by agitation in the material 18 for an infeed period of five (5) minutes while the infeed of air-purging inflow 51 of argon, performed through the inflow tubes 24 and 28, is adjusted. When agitation is completed, the cover 32 in the furnace 12 is removed so as to enable melt surface skimming 54. The process is then completed by mold casting 56 under the pouring temperature followed by cooling of the billet in the mold which may then be removed for machining into an installational product such as a bronze matrix ingot having TiC particles uniformly distributed therein, thereby imparting improved properties such as wear resistance.

The foregoing described process, while successfully applied to fabrication of a metal-matrix composite such as 954 bronze alloy, is also applicable to the fabrication of other metal-matrix composites such as steel, Inconel, aluminum, Nitinol and Monel matrices, as well as the 958 bronze alloy formed from 82% copper, 4% iron, 9% aluminum, 4% nickel and 1% manganese.

Obviously, other modifications and variations of the present invention may be possible in light of the foregoing teachings. It is therefore to be understood that within the scope of the appended claims the invention may be practiced otherwise than as specifically described.

What is claimed is:

1. In a system for fabricating a metal-matrix composite as a metallurgical product by infeed of material into a chamber within which the material undergoes heating to a molten state; a system for improving wear resistance of the metallurgical product obtained by mold casting of the material in said molten state, including the steps of: directing said infeed of the material into the chamber along an infeed path toward a material collection location therein; introducing an air purging gas into the chamber during said infeed of the material at a converging angle to said infeed path; and agitating said material to form a vortex therein at said collection location in the chamber during said infeed of the material and said heating thereof.

2. The system as defined in claim 1, wherein the vortex in the material at the material collection location is established in response to said agitating of the material by rotation of a stirring blade about a rotational axis intersecting the infeed path at the material collection location.

3. The system as defined in claim 1, wherein the material in the molten state is at a pouring temperature under which said mold casting is performed, above a liquidus temperature at which melting occurs within the chamber.

4. The system as defined in claim 1, including the step of: skimming an upper surface of the material in the molten state within the chamber prior to said mold casting.

* * * * *